US005355563A

United States Patent [19]

Kanno

[11] Patent Number: 5,355,563

[45] Date of Patent: Oct. 18, 1994

[54] FASTENER AND ORNAMENTAL DEVICE USING SAME

[75] Inventor: Kiyohiro Kanno, Tokyo, Japan

[73] Assignee: Jatecs Yugen Kaisha, Tokyo, Japan

[21] Appl. No.: 741,509

[22] PCT Filed: Mar. 1, 1991

[86] PCT No.: PCT/JP90/00272

§ 371 Date: Jul. 31, 1991

§ 102(e) Date: Jul. 31, 1991

[87] PCT Pub. No.: WO91/12742

PCT Pub. Date: May 9, 1991

[51] Int. Cl.[5] ..... A44B 9/00

[52] U.S. Cl. ..... 24/708.1; 24/6; 24/708.3

[58] Field of Search ..... 24/708.1, 708.2, 708.3, 24/708.4, 708.5, 708.6, 708.7, 708.8, 709.2, 709.4, 5, 6

[56] References Cited

U.S. PATENT DOCUMENTS

| | | | |
|---|---|---|---|
| 662,962 | 12/1900 | Pitts | 24/708.3 |
| 676,640 | 6/1901 | Theberath et al. | 24/708.1 |
| 1,488,594 | 4/1924 | Gaschke | 24/543 |
| 1,698,843 | 1/1929 | Folkman | 24/708.1 |
| 1,850,623 | 3/1932 | Folkman | 24/708.1 |
| 2,057,006 | 10/1936 | Caccamise | 24/708.4 |
| 2,555,666 | 6/1951 | Young | 24/709.2 |
| 2,692,415 | 10/1954 | Forde | 24/709.4 |
| 3,570,070 | 3/1971 | Rose | 24/6 |

FOREIGN PATENT DOCUMENTS

| | | |
|---|---|---|
| 10164 | 9/1908 | Japan . |
| 10548 | 10/1908 | Japan . |
| 44-3926 | 2/1969 | Japan . |
| 52-165705 | 12/1977 | Japan . |
| 55-129006 | 9/1980 | Japan . |
| 59-154111 | 10/1984 | Japan . |

*Primary Examiner*—Victor N. Sakran
*Attorney, Agent, or Firm*—Juettner Pyle Lloyd & Piontek

[57] ABSTRACT

A fastener g to the invention is used upon being attached to an ornamental device and is freely rotatably connected to a main body of the ornamental device. A pin extending from the connected portion in one direction and a lever of the pin extending from the connected portion in another direction are provided, and the distal end of the pin is biased toward the main body about a rotary shaft at the connected portion. The pin has a difference in level, namely a curved portion, which shifts the axial direction of the pin near its distal end toward the main body. An ornamental device according to the invention has a fastener attached to a main body thereof. The fastener is freely rotatably connected to the main body and is provided with a pin extending from the connected portion in one direction and a lever of the pin extending from the connected portion in another direction, wherein the distal end of the pin is biased toward the main body about a rotary shaft at the connected portion. The pin has a difference in level, namely a curved portion, which shifts the axial direction of the pin near its distal end toward the main body.

5 Claims, 17 Drawing Sheets

FASTENER AND ORNAMENTAL DEVICE USING SAME

TECHNICAL FIELD

This invention relates to a fastener attached to an object such as a garment, and to an ornamental device such as an accessory using this fastener.

BACKGROUND ART

In recent years, accessories such as broaches have been designed to evoke the aesthetic sense of the accessory body to add to the impression of value brought about by diamonds or pearls. In a fastener for attaching the accessory body to an article of clothing, it is required that the fastener have a construction which excels in at least functionality in order to improve its fastening capability.

Three types of fasteners will now be described as typical examples.

FIG. 1A is a side view showing the construction of a broach according to a first example of the prior art, FIGS. 1B–1D are side views showing the manipulating procedure according to the first example of the prior art, FIG. 2A is a front view showing the construction of a principal portion of a broach according to a second example of the prior art, and FIGS. 2B–2D are front views showing the manipulating procedure according to the second example of the prior art.

As illustrated in FIG. 1A, the first example of the prior art is exemplified by a broach 1 in which a fastener 3, which has the construction and function of a safety pin, is attached to the bottom portion 2*a* of a main body 2. The safety pin-type fastener 3 is constructed in such a manner that one end 5*b* of a pin 5 is wound about a shaft 4 to form a spring, while the other, free end 5*a* of the pin is biased in a direction, which is indicated by arrow D1, against a force from the direction indicated by arrow U1. When the broach is not being used or has been attached, the other end 5*a* is received in an accommodating portion 3*c* formed into a frame-shaped configuration. Part of the accommodating portion 3*c* includes a freeing portion composed of a tongue portion 3*a* and a tongue portion 3*b* in order that the pin 5 may be taken in and out.

As for the method of manipulating the first example of the prior art, the user first applies a force to the pin 5 in the direction of arrow U1 starting from the state of the broach shown in FIG. 1A to urge the pin upward to the positions of the tongue portions 3*a*, 3*b* (FIG. 1B). Owing to this external force, the pin 5 produces a biasing force in the direction of arrow D1. Next, with the broach in the state shown in FIG. 1B, the user passes the free end 5*a* through the tongue portions 3*a*, 3*b* and removes the force in the direction of arrow U1 when the free end 5*a* emerges from between the tongue portions. The state of the pin shown in FIG. 1C is thus obtained. The user then passes the pin 5 through a garment 6 at a desired position thereof, after which the free end 5*a* is placed in the pin accommodating portion 3*c* in accordance with a procedure which is the reverse of that followed when the free end 5*a* of the pin 5 was extracted from the pin accommodating portion 3*c*.

In this first example of the prior art, the free end 5*a* is extracted from the pin accommodating portion 3*c* (FIG. 1C) and the pin 5 is passed through the garment 6 (FIG. 1D), after which the free end 5*a* is again urged upward toward the main body 2 to obtain the accommodated state of the free end 5*a* illustrated in FIG. 1A. Such manipulation is troublesome for the user to perform. More specifically, operations for extracting and accommodating the free end 5*a* are performed for a single fastening operation, and thus poor functionality resulting from these two tasks is conspicuous. Of course, the same troublesome-operations are performed also when the broach 1 is detached from the garment 6.

As illustrated in FIG. 2A, the second example of the prior art is exemplified by a broach 11. As in the first example of the prior art, a fastener 13, which has the construction and function of a safety pin, is attached to the bottom portion 12*a* of a main body 12. As in the first example of the prior art, the safety pin-type fastener 13 is constructed in such a manner that one end 15*b* of a pin 15 is wound about a shaft 14 to form a spring, while the other, free end 15*a* of the pin is biased in a direction, which is indicated by arrow D2, against a force from the direction indicated by arrow U2. When the broach is not being used or has been attached, the free end 15*a* is received in a pin accommodating portion comprising a disk-shaped stationary portion 16 provided on the distal end of a support 18, and a disk-shaped loose-fitting portion 17 which covers the surface of the stationary portion 16 and retains the stationary portion in a loosely fitted state. The loose-fitting portion 17 has a knob 17*a* projecting from a side face thereof. The user presses a finger against the knob 17*a* so that the loose-fitting portion 17 can be rotated on the surface of the stationary portion 16 in the direction indicated by arrow R1 (as well as in a direction opposite this arrow). When the loose-fitting portion 17 is rotated, openings 17*b*, 16*b* respectively provided on the loose-fitting portion 17 and stationary portion 16 can be made to coincide, as will be described later, so that the free end 15 of the pin 15 can be taken out along the openings 17*b*, 16*b*.

As for the method of manipulating the second example of the prior art, the user first rotates the loose-fitting portion 17 in the direction of arrow R1 starting from the state shown in FIG. 2A, and brings the opening 17*b* of loose-fitting portion 17 and the opening 16*b* of stationary portion 16 into coincidence to obtain a pin extracting space 19 (FIG. 2B) for extracting the free end 15*a*. In this operation, the user holds the main body 12 with one hand while using the other hand to perform the manipulations that obtain the pin extracting space 19. The user then urges the free end 15*a* upward in the direction of arrow U2 and removes the force applied in the direction of arrow U2 when the free end is extracted from the openings 16*b*, 17*b*. The state of the free end 15*a* shown in FIG. 2C can thus be obtained. The user then passes the pin 15 through a garment 20 at a desired position thereof, after which the free end 15*a* is placed in the pin accommodating portion in accordance with a procedure which is the reverse of that followed when the free end 15*a* of the pin 15 was extracted from the pin accommodating portion.

Thus, with the second example of the prior art, it is required that both hands be used to attach and detach the broach. If a hand-held bag is being carried when the broach is attached or detached, the bag must be put down temporarily. This is troublesome.

In order to eliminate the aforementioned operation-related annoyances of the first and second examples of the prior art, Japanese Utility Model Publication No. 44-3926 (hereinafter referred to as the "third example of the prior art"), which was filed in Japan on Nov. 24, 1964, discloses a clasp having an arrangement in which the rear ends of a base piece having a pin and of a base piece serving as a main body are connected in such a manner that the distal ends of both base pieces are directly mutually inward using the elastic force of a spring. In accordance with this disclosure, the biasing direction of the spring is directed toward the base piece on the main-body side opposite the biasing direction of the pins described in the first and second examples of the prior art. This is advantageous in that after passing the pin through the garment, the user need only remove the force holding the pin open. However, the base piece on the main-body side that receives the distal end of the pin is provided with a projection having a V-shaped notch, and the distal end of the pin is received by the notch. Consequently, it is possible that the garment through which the pin has been passed will readily reach the tip of the pin, and this can cause the tip of the pin to easily become detached from the projection.

Accordingly, in the third example of the prior art, the arrangement for reliably holding the ornament in the fastened state is deficient.

DISCLOSURE OF THE INVENTION

An object of the present invention is to eliminate the aforementioned drawbacks of the examples of the prior art described above.

Another object of the present invention is to provide a fastener in which cost can be reduced by virtue of a simple construction.

Another object of the present invention is to provide a fastener which is simple in construction and easy to manipulate.

Another object of the present invention is to provide a fastener which is simple in construction and very safe.

Another object of the present invention is to provide a fastener in which the attachment to an object can be reliably maintained by a simple construction.

Another object of the present invention is to provide a fastener capable of limiting movement of an object, through which a pin has been passed, by a simple construction.

Another object of the present invention is to provide a fastener capable of applying frictional resistance to movement of an object, through which a pin has been passed, by a simple construction.

Another object of the present invention is to provide a fastener in which opening and closing of a pin can be performed in excellent fashion through a simple construction irrespective of overall size.

Another object of the present invention is to provide an ornamental device that uses a fastener in which cost can be reduced by virtue of a simple construction.

Another object of the present invention is to provide an ornamental device that uses a fastener which is simple in construction and easy to manipulate.

Another object of the present invention is to provide an ornamental device that uses a fastener which is simple in construction and very safe.

Another object of the present invention is to provide an ornamental device that uses a fastener in which the attachment to an object can be reliably maintained by a simple construction.

Another object of the present invention is to provide an ornamental device that uses a fastener capable of limiting movement of an object, through which a pin has been passed, by a simple construction.

Another object of the present invention is to provide an ornamental device that uses a fastener capable of applying frictional resistance to movement of an object, through which a pin has been passed, by a simple construction.

Another object of the present invention is to provide an ornamental device that uses a fastener in which opening and closing of a pin can be performed in excellent fashion through a simple construction irrespective of overall size.

Another object of the present invention is to provide a fastener used upon being attached to a main body of an ornamental device, comprising connecting means for freely rotatably connecting the fastener to the main body, a pin extending in one direction and a pin lever extending in another direction from a portion connected at the connecting means, and biasing means for biasing a distal end of the pin toward the side of the main body about a rotary shaft constituted by the connecting means, the pin including difference-in-level means for shifting the axial direction of the pin in the proximity of its distal end toward the side of the main body.

Another object of the present invention is to provide a fastener further comprising accommodating means for accommodating the distal end of the pin at a portion where the biasing means causes the distal end of the pin to abut against an outer surface of the main body.

Another object of the present invention is to provide a fastener in which the accommodating means has a follower which rotates to follow up motion of the distal end of the pin when this distal end is received by and extracted from the accommodating means, the follower being axially supported on the accommodating means and adapted to cover the distal end of the pin after the distal end is received.

Another object of the present invention is to provide an ornamental device which uses a fastener, the fastener comprising connecting means for being freely rotatably connected to the main body, a pin extending in one direction and a pin lever extending in another direction from a portion connected at the connecting means, and biasing means for biasing a distal end of the pin toward the side of the main body about a rotary shaft constituted by the connecting means, the pin including difference-in-level means for shifting the axial direction of the pin in the proximity of its distal end toward the side of the main body.

Another object of the present invention is to provide an ornamental device in which the fastener further comprises accommodating means for accommodating the distal end of the pin at a portion where the biasing means causes the distal end of the pin to abut against an outer surface of the main body.

Another object of the present invention is to provide an ornamental device in which the accommodating means has a follower which rotates to follow up motion of the distal end of the pin when this distal end is received by and extracted from the accommodating means, the follower being axially supported on the accommodating means and adapted to cover the distal end of the pin after the distal end is received.

Other objects of the present invention will be apparent from the following description and claims based upon the accompanying drawings.

BEST MODE FOR CARRYING OUT THE INVENTION

Preferred embodiments of the present invention will now be described in detail with reference to the accompanying drawings.

First Embodiment

Figure 1A:
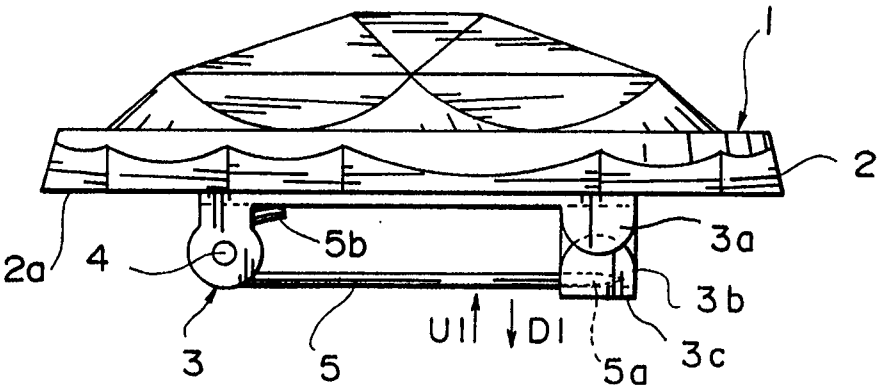
FIG. 1A is a side view showing the construction of a broach according to a first example of the prior art.
Figure 1B:
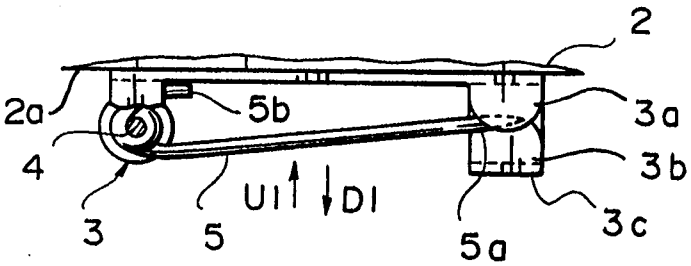
FIGS. 1B–1D are side views showing a manipulating procedure according to the first example of the prior art.
Figure 1C:
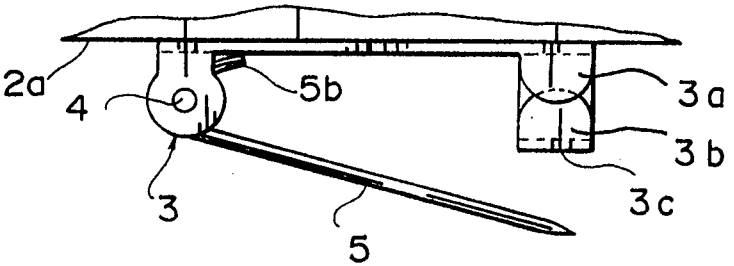
Figure 1D:
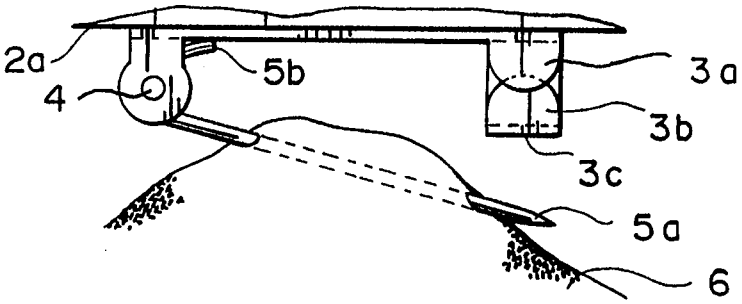
Figure 2A:
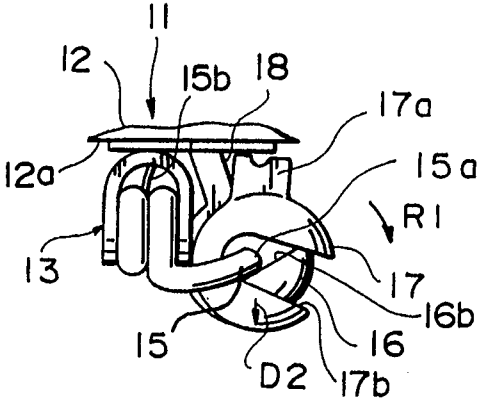
FIG. 2A is a front view showing the construction of a principal portion of a broach according to a second example of the prior art.
Figure 2B:
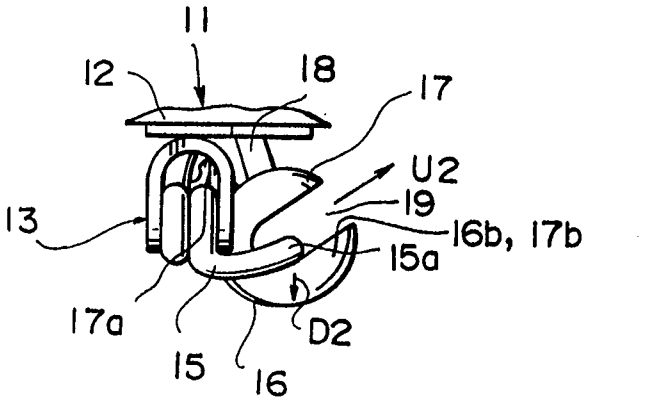
FIGS. 2B–2D are front views showing the manipulating procedure according to the second example of the prior art.
Figure 2C:
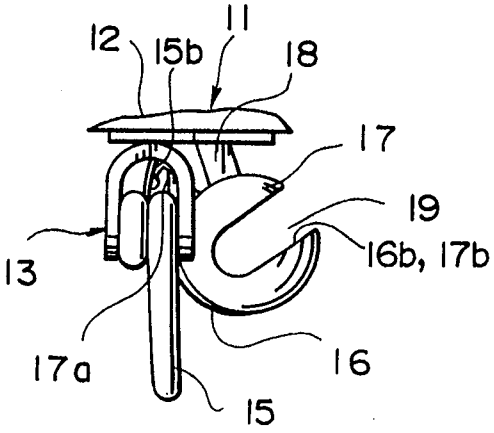
Figure 2D:
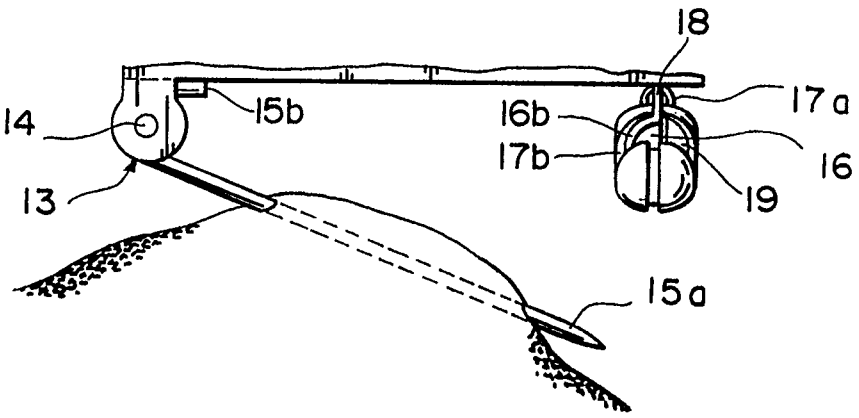
Figure 3:
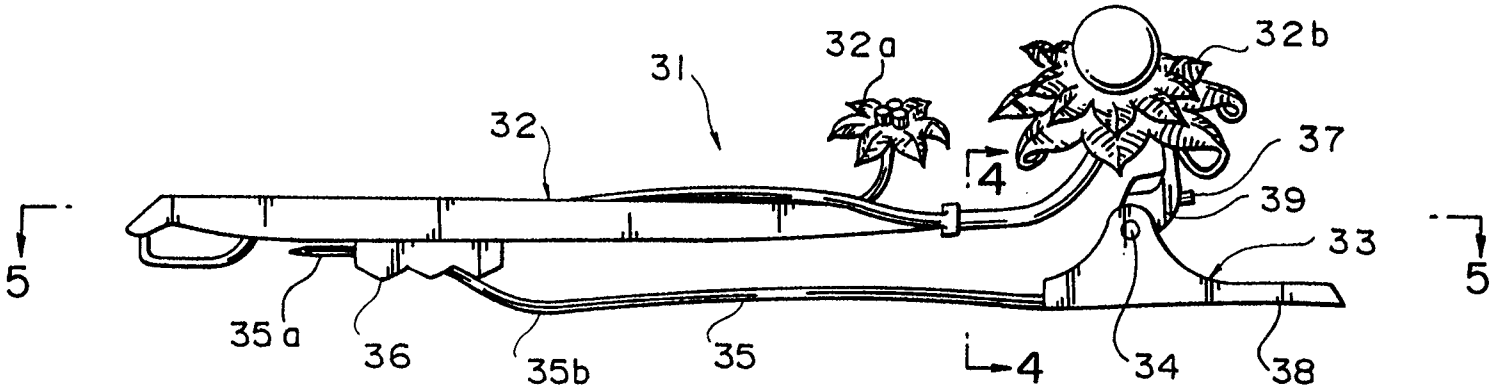
FIG. 3 is a side view showing the construction of a broach according to a first embodiment.
Figure 4:
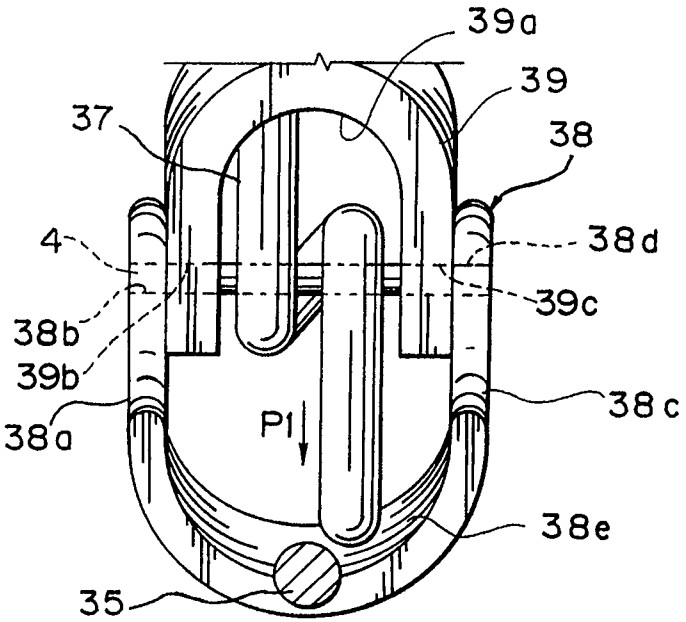
FIG. 4 is a front sectional view showing a cross section taken along line 4—4 of the broach shown in FIG. 3.
Figure 5:
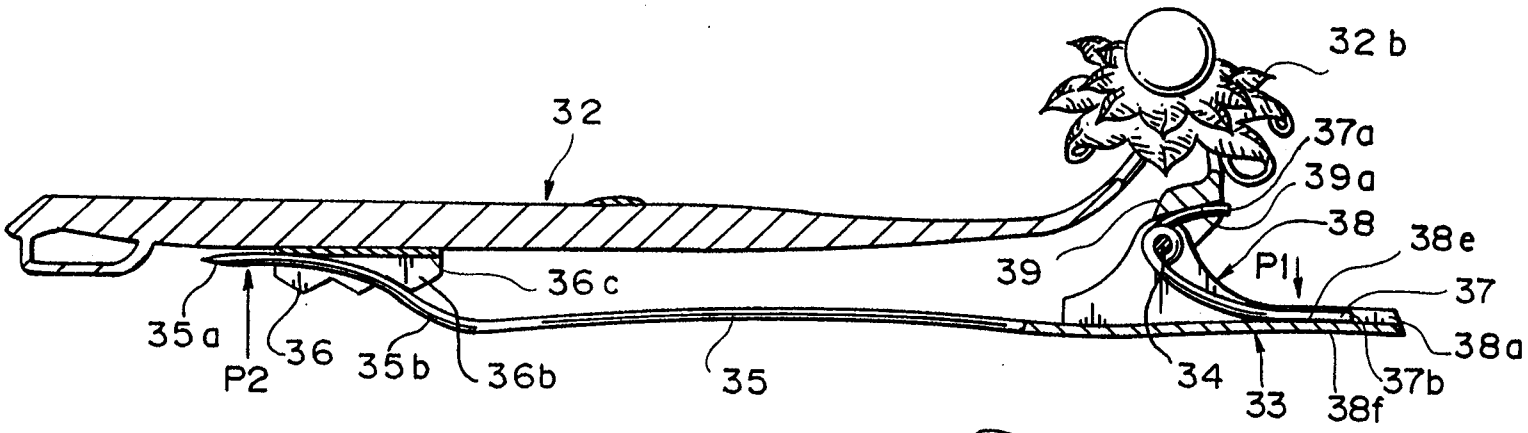
FIG. 5 is a side sectional view showing a cross section taken along line 5—5 of the broach shown in FIG. 3.

FIG. 3 is a side view showing the construction of a broach according to a first embodiment, FIG. 4 is a front sectional view showing a cross sectional taken along line 4—4' of the broach shown in FIG. 3, FIG. 5 is a side sectional view showing a cross section taken along line 5—5' of the broach shown in FIG. 3.

As illustrated in FIG. 3, a broach 31 according to the first embodiment basically includes a main body 32 and a fastener 33. The main body 32 has ornamental portions **32*a*, 32*b* on which ornaments such as a diamond or pearl are mounted. The fastener 3 comprises a lever 38, which has a mechanism for being attached to an article of clothing, and a pin 35. At its rear part the main body 32 has a connection portion 39 for freely rotatably supporting the lever 38 of the fastener 33 by a shaft 34. Furthermore, at least the surface of the main body opposite the pin 35 is provided with a pin accommodating portion 36 for receiving and accommodating a distal end 35*a* of the pin 35 attached so as to extend forwardly from the lever 38. The pin accommodating portion 36 has a U-shaped configuration and, as shown in FIGS. 3 and 5, has acute-angled projections on the upper surfaces of downwardly extending side portions 36*a*, 36*b***.

The overall length of the pin 35 is set depending upon the length of the main body 32. Further, the pin 35 has a curved portion **35*b* obtained by bending the pin near its tip end 35*a* toward the side of main body 32 with respect to the axial direction of the pin 35. Owing to the curve formed by the curved portion 35*b*, a pocket is formed between the pin 35 and the main body 32 so the broach 31 can be adapted to a garment having some thickness. The curved portion 35*b* forms a difference-in-level in level portion with respect to the axial direction of the main body of pin 35. As will be set forth later, this functions so as to apply a brake to shifting of a garment through which the pin 35** has been passed.

A torsion coil spring 37 is attached at the connection portion 39 (FIGS. 4 and 5), which axially supports the fastener 33, in such a manner that the pin 35 rotates about the shaft 4 in the direction indicated by arrow P2. End portions **37*a*, 37*b* of the torsion coil spring 37 are arranged so as to respectively come into pressured contact with a bottom portion 39***a* of the connection portion 39 and a bottom portion 38*e* of the lever 38. At this time the end portion 37*b* of the torsion coil spring 37 acts so as to rotate the lever 38, namely the fastener 33, clockwise in the case of FIG. 5. As a result, the distal end portion 35*a* of the pin 35 comes into pressured contact with a bottom portion 36*a* of the pin accommodating portion 36 serving as an obstacle in the direction of arrow P2.

As shown in FIG. 4, the lever 38 and the connection portion 39 each have a U-shaped configuration. The U-shaped shaped part of the connection portion 39 engages, in an inverted state, with the inner side of the U-shaped part of lever 38, whereby engaged portions are formed at two locations. These two engaged portions are formed to have a series of insertion holes by holes 38*b*, 38*d* provided in the lever 38 and holes 39*b*, 39*c* provided in the connection portion 39. When the shaft 4 is passed through the insertion holes, the end portions 37*a*, 37*b* of the torsion coil spring 37 are attached so as to point backwardly in FIG. 4.

In order to make it easier to apply finger pressure, the lever 38 has a backwardly extending pressure-applying portion 38*f*, as illustrated in FIGS. 3 and 5. There is no particular restriction upon the length of the pressure-applying portion 38*f* so long as there is sufficient area for applying finger pressure and no harm is done to the overall aesthetic sensation of the broach 31, namely to the balance of the external appearance. In addition, it will suffice if the connecting portions of the lever 38 and pin 35 are joined by a technique such as brazing.

Gold, silver, platinum, brass and the like are ideal as the material of the main body 32 and fastener 33.

An attaching method according to the first embodiment will now be described.

FIGS. 6A through 6D are side views for describing a procedure for attaching the broach according to the first embodiment.

Figure 6A:
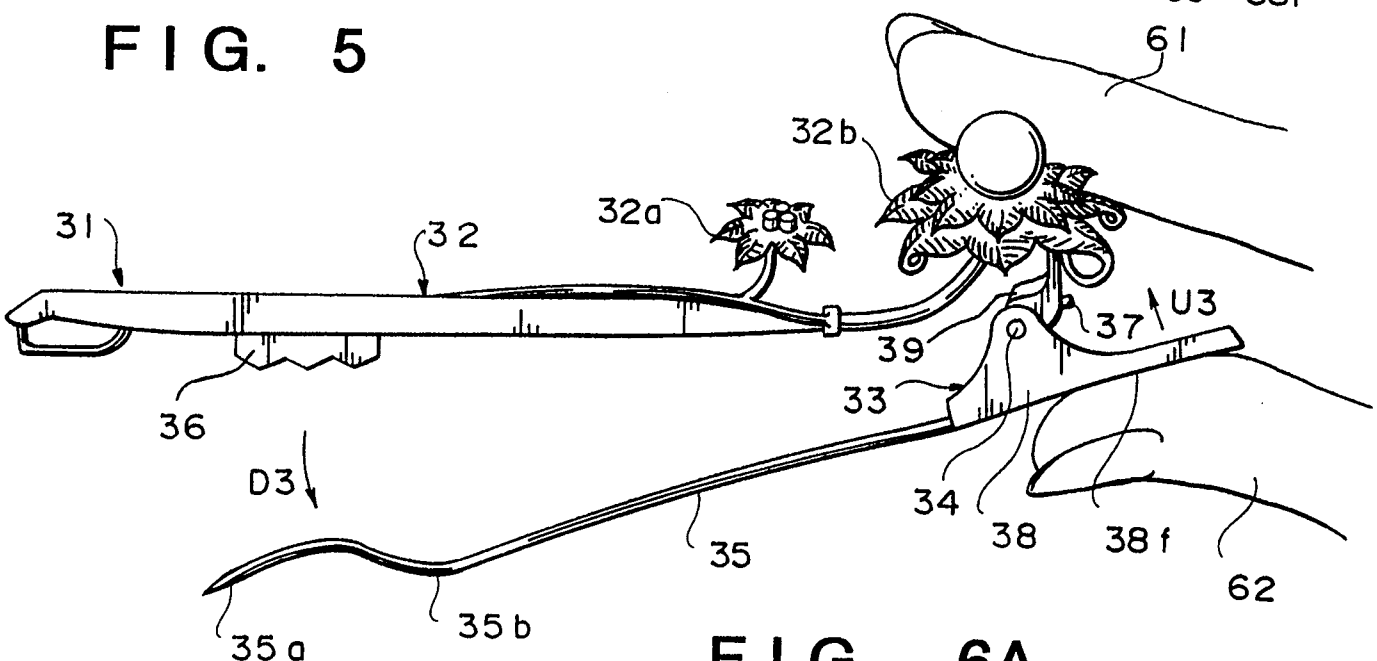
FIGS. 6A–6D are side views for describing a broach attaching procedure according to the first embodiment.
Figure 6B:
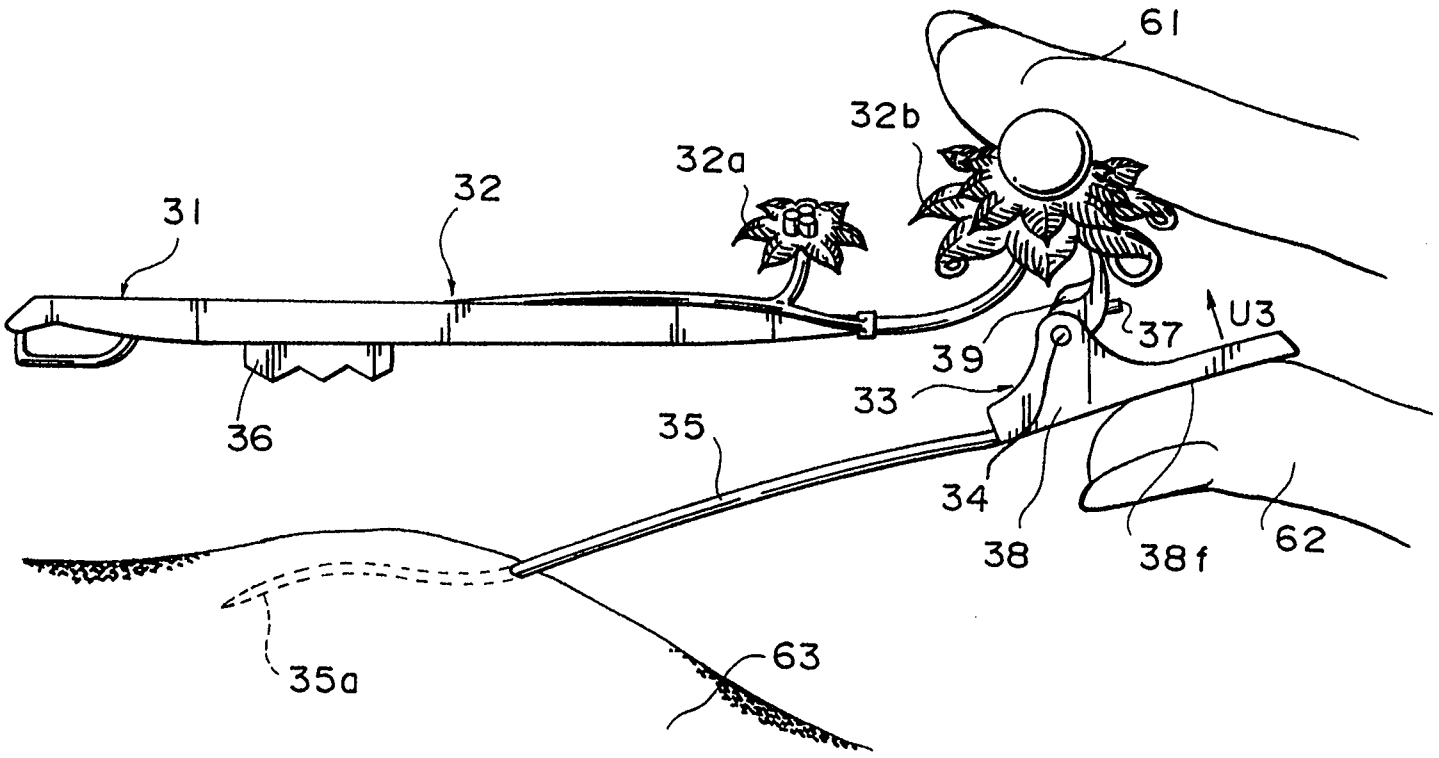
Figure 6C:
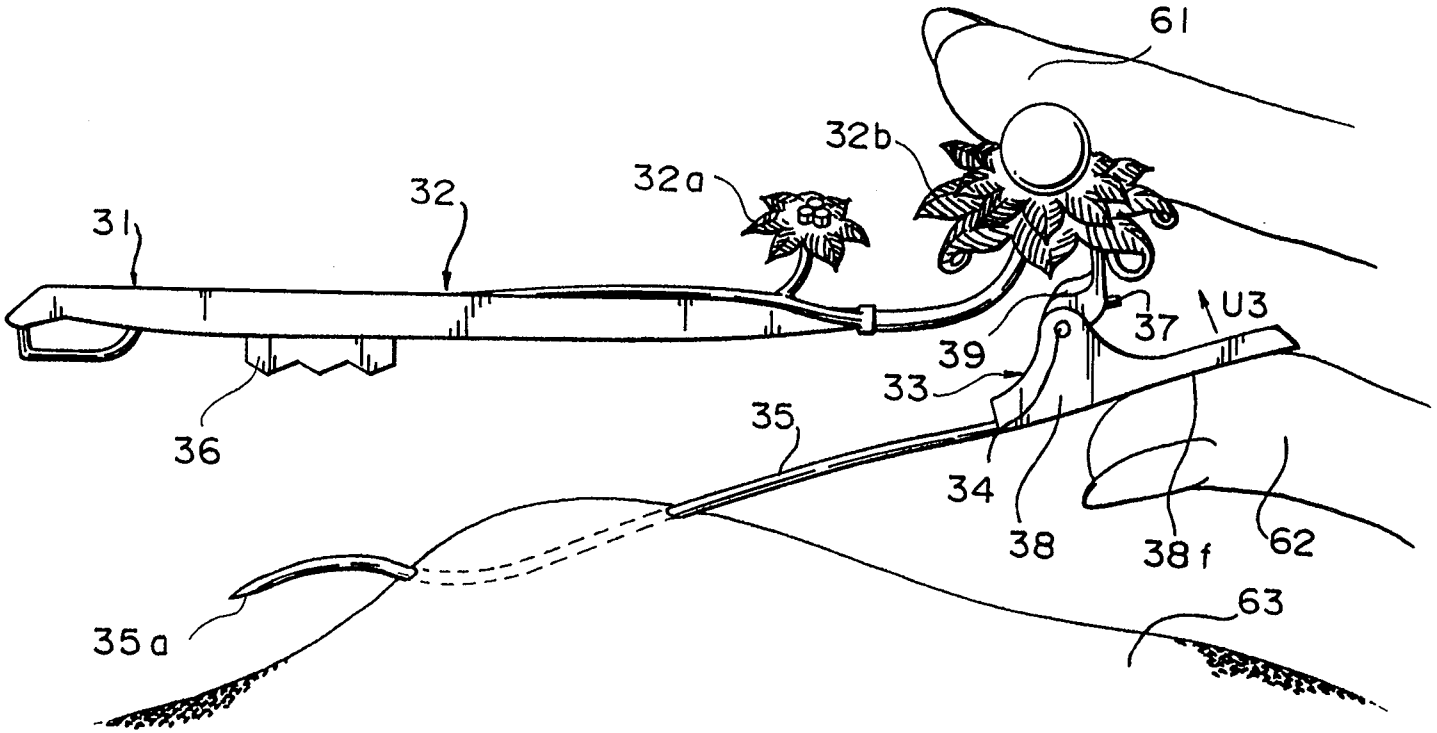
Figure 6D:
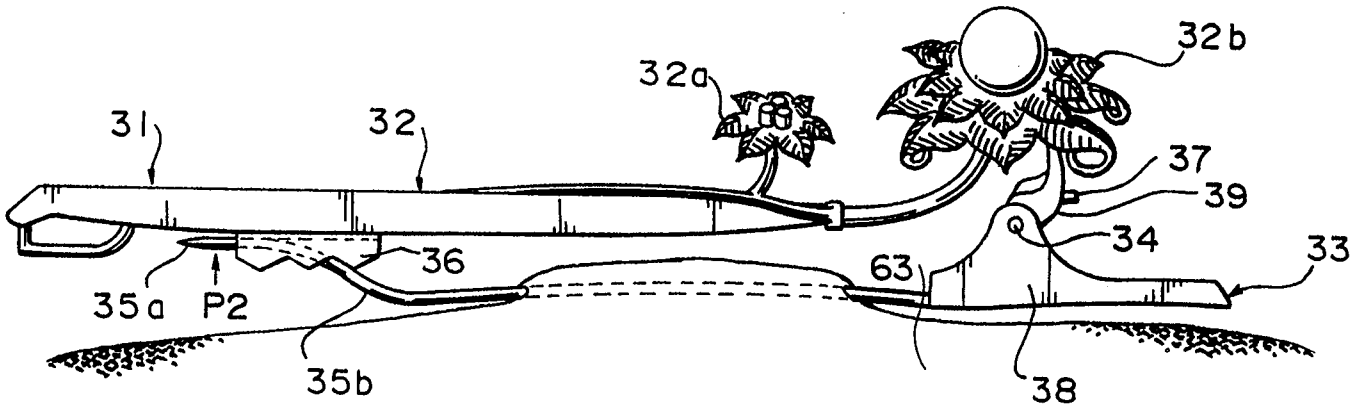

First, the user pinches the ornamental portion 32*b* of the main body 32 and the fastener 33 using the thumb and index finger so as to urge the pressure-applying portion 38*f* of lever 38 upward in the direction indicated by arrow U3, whereby the tip 35*a* of the pin 35 is caused to separate from the pin accommodating portion 36 in the direction indicated by arrow D3 (FIG. 6A). While holding the broach 31 in the state shown in FIG. 6A, the user passes the distal end of the pin 35 through a garment 63 at a desired position thereof so that the tip 35*a* of the pin 35 penetrates the garment 63 on its inner side (FIG. 6B). When the tip 35*a* of the pin 35 has penetrated to the inner side of the garment 63, the user passes the tip 35*a* through the garment 63 again in reverse fashion so that the tip emerges from the outer side of the garment (FIG. 6C). When the user has thus finished passing the pin 35 through the garment 63, the user removes the U-direction pressing force acting upon the lever 38. When the pressing force is removed, the lever 33, namely the fastener 33, is restored to its initial state shown in FIG. 3 owing to the biasing force of the torsion coil spring 37 (FIG. 6D). In the manipulation of the broach 31 described in connection with FIG. 6D, the user need only remove the force that opens the distal end of the pin 35. In other words, the user need only remove the hand from the broach 35. Further, even if the garment 63 shifts toward the distal end of the pin 35 in the state shown in FIG. 6D, the curved portion 35b functions as a stopper so that movement of the garment 63 up to the tip 35*a* is prevented. In addition, since the projections provided on the sided portions 36*a*, 36*b* of the pin accommodating portion 36 slide the garment 63, shifting of the garment can be held in check.

As a result, in accordance with the first embodiment, the broach is capable of being held reliably in a state attached to a garment. Further, a single manipulation for opening the distal end of the pin 5 suffices, and no additional labor whatsoever is required with regard to the pin 35 after the pin is passed through the garment 63. As a consequence, the broach obtained is very simple to manipulate. In other words, the broach has improved operability. At the same time, since there are but few parts, construction is very simple and the broach can be manufactured at low cost. Furthermore, the fact that construction is very simple makes it possible to freely design the broach main body without detracting from the aesthetic sense of the external appearance of the broach and without affecting the construction of the fastener.

Though a torsion coil spring is used as the spring in the first embodiment described above, the invention is not limited thereto, for a leaf spring also can be used.

A modification of the first embodiment will now be described.

First Modification

Though the first modification is composed of parts similar to those of the first embodiment described above, the method of attaching the fastener and the method of manipulating the fastener differ.

Figure 7:
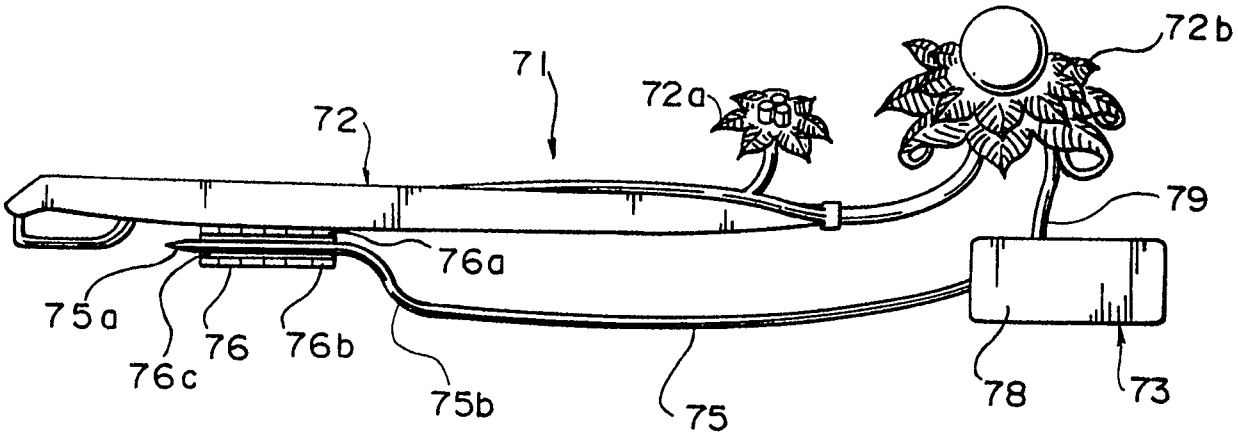
FIG. 7 is a side view showing the construction of a broach according to a first modification of the first embodiment.
Figure 8:
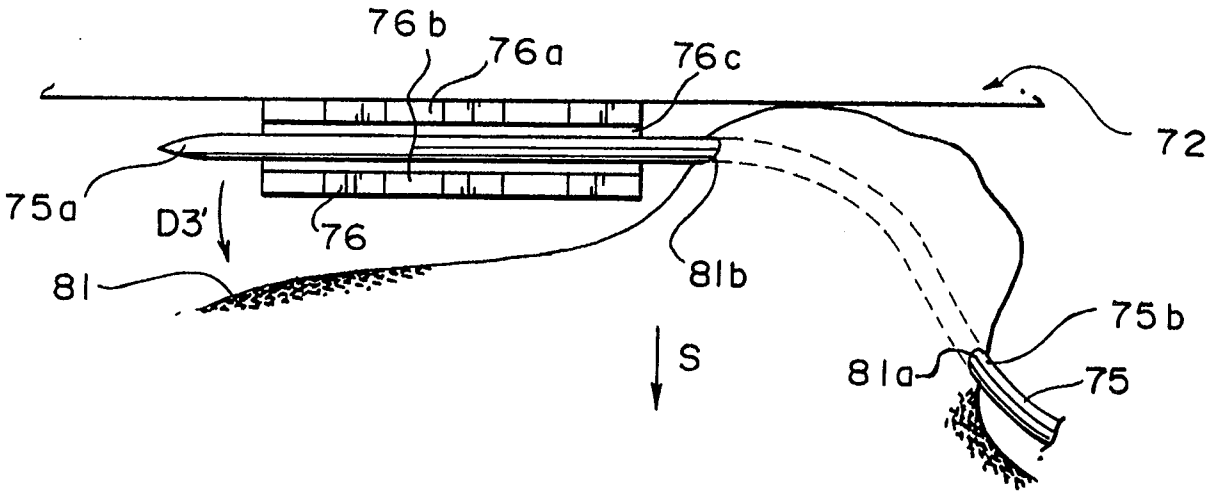
FIG. 8 is an enlarged view of a principal portion showing an example in which the broach is attached in the first modification of the first embodiment.

FIG. 7 is a side view illustrating the construction of a broach according to a first modification of the first embodiment, and FIG. 8 is an enlarged view of a principal portion showing an example of attaching the broach according to the first modification of the first embodiment. In FIG. 7, a broach 71 according to the first modification includes a main body 72 having ornamental portions 72*a*, 72*b*, and a fastener 73 axially supported on a connection portion 79 provided rearwardly of the fastener 72, similar to the broad 31 illustrated in FIG. 3. The first modification is similar to the first embodiment with regard to the construction in which a lever 78 is axially supported on the connection portion 79. The direction in which a tip 75*a* of a pin 75 joined to the lever 78 is biased is rearward in FIG. 7. With regard to the main body 72, a pin accommodating portion 76 which receives the tip 75*a* of the pin 75 is attached in such a manner that a bottom portion 76*c* is directed forwardly in FIG. 7.

The manipulating procedure followed by the user is similar to that of the first embodiment described. The only difference is the rotating direction of the fastener 73 relative to the main body 72. In a case where a garment 81 shifts substantially up to the pin accommodating portion 76 via a curved portion 75*b*, as shown in FIG. 8, after the broach 71 has been attached, a downward pulling force or a moving force in the direction indicated by the arrow S acts upon the pin 75. However, in the state illustrated in FIG. 8, the construction in such that the direction in which the pin 75 is allowed to move, i.e., rotate, is limited solely to forward rotation in the drawing about the shaft (not shown) of the lever 78. Accordingly, the pin 75 does not rotate in the direction indicated by arrow D3', and the broach 71 can be maintained in the attached state as long as the user does not remove the broach 71 in accordance with the procedure.

In the first modification, the rotational plane of the fastener 73 in the attached state is formed to be substantially parallel to the garment 81, and therefore the attached state can be maintained more reliably in comparison with the first embodiment.

Second Modification

Figure 9:
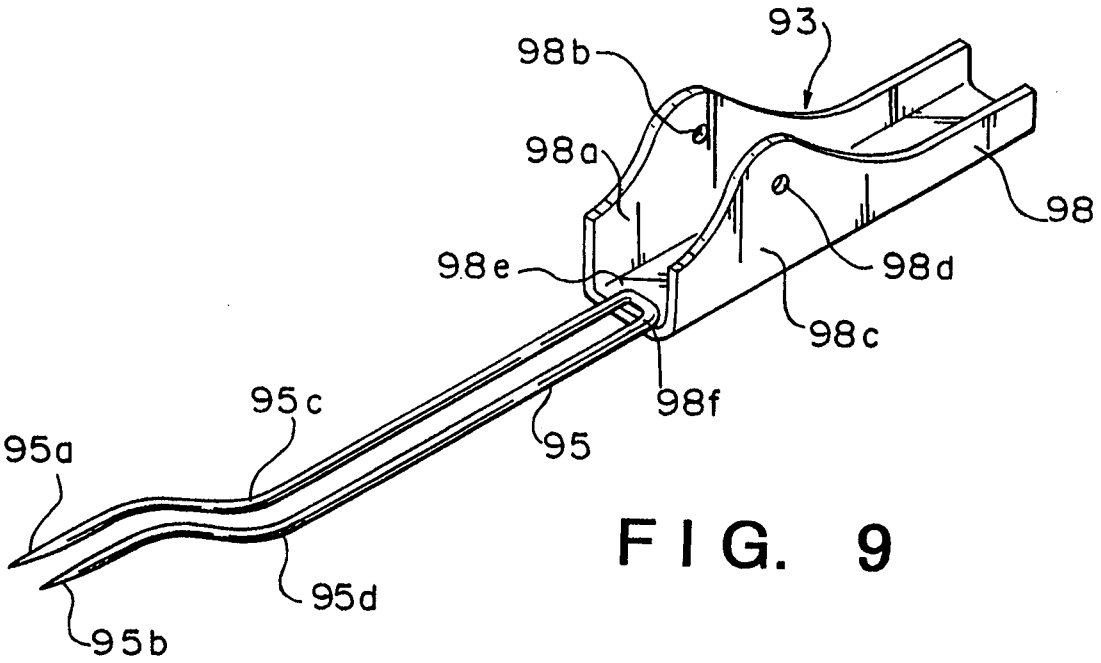
FIG. 9 is an external perspective view showing the construction of a principal portion according to a second modification of the first embodiment.

FIG. 9 is an external perspective view illustrating the construction of a principal portion of a second modification of the first embodiment.

The broach of the second modification has a fastener different from that of the first embodiment. As shown in FIG. 9, a fastener 93 of the second modification has a lever 98, the cross section of which is U-shaped, similar to that of the first embodiment. The lever 98 has a bottom portion 98*e* to the distal end 98*f* of which is joined a U-shaped parallel pin 95 by means of a brazing process. Each pin of the parallel pin 95 has a curved portion (95*c*, 95*d*) near the tip (95*a*, 95*b*), just as in the first embodiment. FIG. 9 illustrates only the fastener 93. However, in a case where the broach of the second modification is actually constructed, a shaft (not shown) is passed through holes 98*b*, 98*d* respectively provided in side portions 98*a*, 98*c* of the lever 98, and the fastener is provided on the main body (not shown) so as to be axially supported, just as in the first embodiment.

Thus, in the second modification, the broach is fastened to the garment at two locations by using the parallel pin 95 having the two parallel pins. As a result, stability when the broach is attached is improved in comparison with the case where fastening is achieved at one location, as in the first embodiment.

Though the parallel pin is composed of two pins in the second modification described above, the present invention is not limited thereto, for three or more pins can be used if the arrangement is within the scope of the invention. In addition, it is permissible to construct the fastener not by adopting an integrated structure for the parallel pins but by preparing pins corresponding to the number of pins to be set and joining these pins to the lever one at a time in parallel relation.

Third Modification

Figure 10:
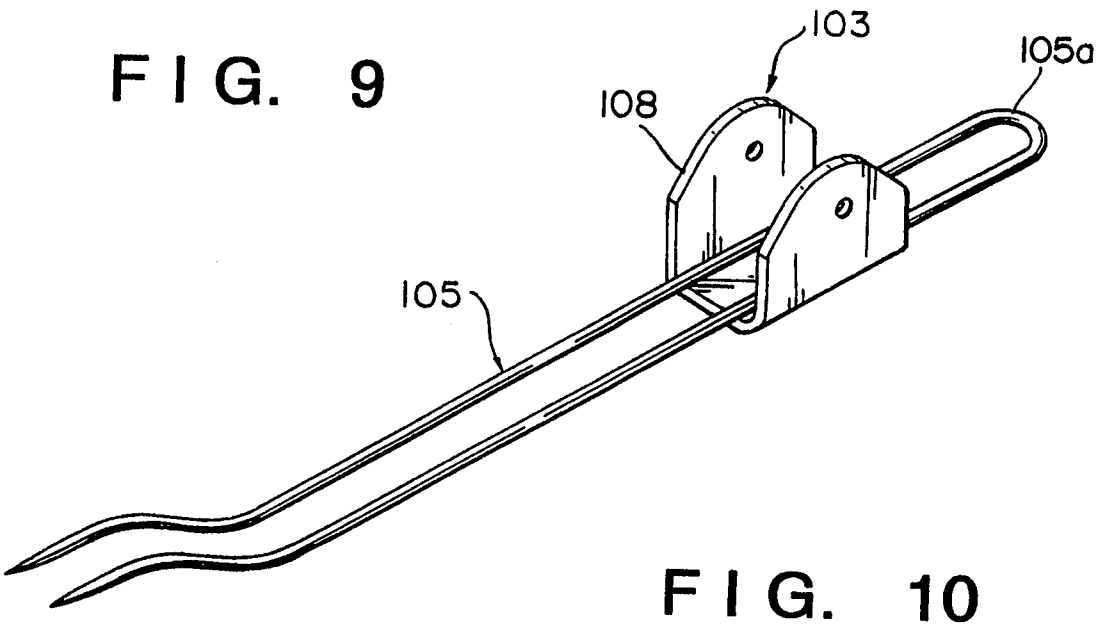
FIG. 10 is an external perspective view showing the construction of a principal portion according to a third modification of the first embodiment.

FIG. 10 is an external perspective view illustrating the construction of a principal portion of a third modification of the first embodiment.

In the third modification, a parallel pin 105 having a shape similar to that of the second modification is used, as illustrated in FIG. 10. A fastener 103 of the third modification has an arrangement in which a folded portion 105*a* of the parallel pin 105 is exposed from the rear end of a lever 108 having a construction from which the pressure-applying portion is deleted. This pressure-applying portion is formed by the exposed portion.

The third modification also is attached by a manipulation method similar to that of the second modification.

Fourth Modification

The fourth modification has, as a structural element, a fastener having a parallel pin, as in the second and third modifications.

Figure 11:
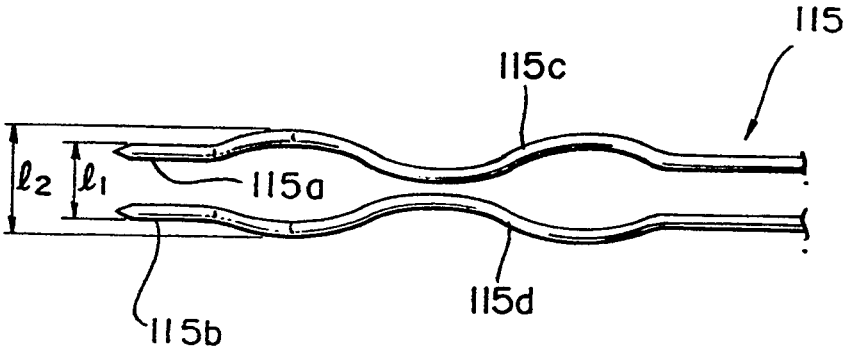
FIG. 11 is a bottom view showing the construction of a principal portion according to a fourth modification of the first embodiment.
Figure 12:
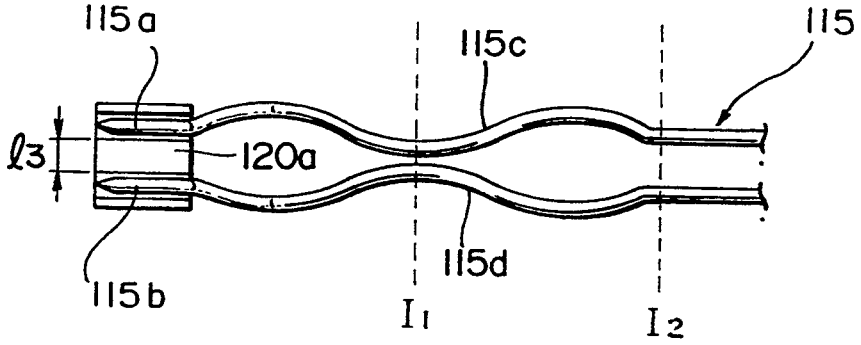
FIG. 12 is a bottom view for describing for describing an example in which the broach is attached in the fourth modification of the first embodiment.

FIG. 11 is a bottom view illustrating the construction of a principal portion of a fourth modification of the first embodiment, and FIG. 12 is a bottom view for describing an example of attaching the fourth modification of the first embodiment.

A parallel pin 115, which is a part of the fastener, has curved portions similar to those of the second and third modifications, as well as curved portions 115*c*, 115*d* symmetrically forming a widened portion and a narrowed portion in directions opposing the two pins. The widened portion formed by the curved portions 115*c*, 115*d* is set to have a distance ($l_2$ in FIG. 11) at least greater than a distance ($l_1$ in FIG. 11) between tips 115*a*, 115*b*.

When the user actually passes the parallel pin 115 having the foregoing characterizing feature through a garment to attach the broach, the portions where the parallel pin 115 intersects the dashed lines I1, I2 in FIG. 12 are the portions where the garment is pierced. In the fourth modification, a projection 120*a* is provided for limiting the positions between the pins when a pin accommodating portion 120 receives the parallel pin 114. The width of the projection 120*a* is indicated by $l_3$ in the direction opposing the two pins. The relationship among $l_1$, $l_2$, $l_3$ is as follows:

$$l_2/2-l_1/2=l_1/2-l_3/2 \quad (1)$$

The distance between the holes when the parallel pin 115 is passed through the garment is substantially decided by the tips 115*a*, 115*b*. Accordingly, even if the garment attempts to move toward the tips of the parallel pin 115 from the state shown in FIG. 12, by way of example, the distance between the tips 115*a*, 115*b* can only be narrowed to the minimum value $l_3$ because of the relationship expressed by Eq. (1) above. This prevents movement of the garment because the pin width having the maximum distance $l_2$ between the pins cannot be made to attain the distance $l_1$. Thus, in accordance with the fourth modification, the effect of preventing displacement of the garment, namely the effect of preventing the broach from readily slipping off while being worn, is added to the effects of the second and third modifications.

In the fourth modification described above, the curved portions in the directions opposing the two pins form widened portions, at two locations, that are larger than the widened portion at the tips of the pins. However, the present invention is not limited to this arrangement, for widened portions can be provided at one location or at three or more locations in conformity with the axial length of the parallel pin set depending upon the size, etc., of the broach.

Fifth through Ninth Modifications

Fifth through ninth modifications in which the shape of the pin of the first embodiment is modified will now be described.

Figure 13:
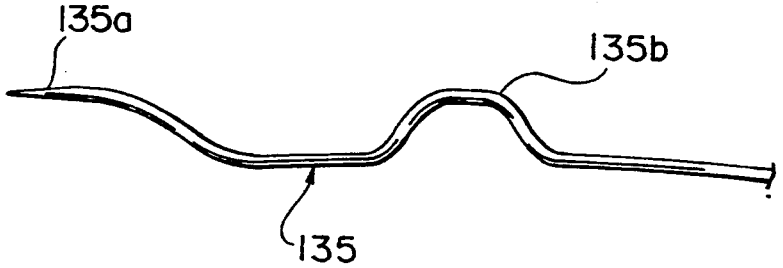
FIG. 13 is a side view showing a principal portion of a fifth modification in which a pin of the first embodiment is modified.
Figure 14:
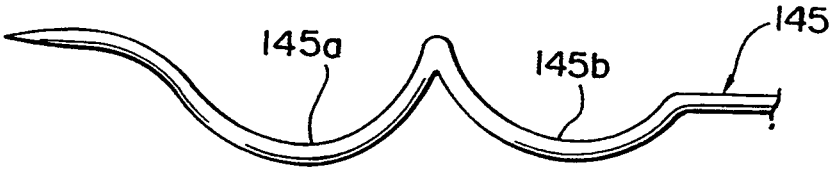
FIG. 14 is a side view showing a principal portion of a sixth modification in which a pin of the first embodiment is modified.
Figure 15:
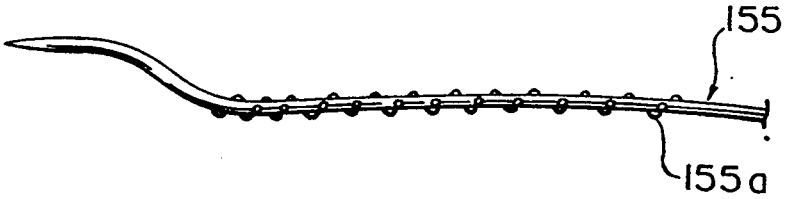
FIG. 15 is a side view showing a principal portion of a seventh modification in which a pin of the first embodiment is modified.
Figure 16:
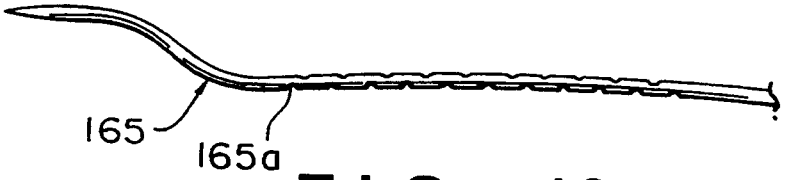
FIG. 16 is a side view showing a principal portion of a eighth modification in which a pin of the first embodiment is modified.
Figure 17A:
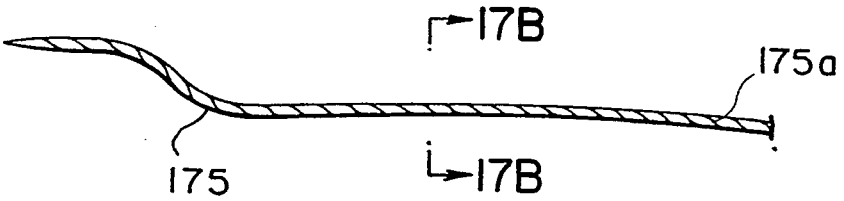
FIG. 17A is a side view showing a principal portion of a ninth modification in which a pin of the first embodiment is modified.
Figure 17B:
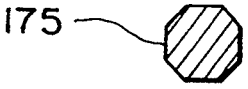
FIG. 17B is a side sectional view showing a cross section taken along line 17B—17B of the pin illustrated in FIG. 17A.

FIG. 13 is a side view showing a principal portion of a fifth modification in which a pin of the first embodiment is modified; FIG. 14 is a side view showing a principal portion of a sixth modification in which a pin of the first embodiment is modified; FIG. 15 is a side view showing a principal portion of a seventh modification in which a pin of the first embodiment is modified; FIG. 16 is a side view showing a principal portion of a eighth modification in which a pin of the first embodiment is modified; FIG. 17A is a side view showing a principal portion of a ninth modification in which a pin of the first embodiment is modified; and FIG. 17B is a side sectional view showing a cross section taken along line 17B—17B of the pin illustrated in FIG. 17A.

First, according to the fifth modification shown in FIG. 13, a portion of the main body of a pin 135 is provided with a projection 135*b* protruding toward the side of the main body, not shown. The amount of protrusion of the projection 135*b* is set to be approximately equal to a difference in level, in the axial direction, of the pin main body, which has a tip 135*b*. Accordingly, when the broach according to the fifth modification is attached, displacement of the garment, not illustrated, can be limited by clamping the garment between the projection 135*b* and the broach main body, or by situating the garment on the side of the lever (not shown), with the projection 135*b* serving as a boundary.

Next, according to the sixth modification shown in FIG. 14, the main body of a pin 145 is provided with curved portions 148*b*, 148*c* which describe arcs in a direction facing away from the broach main body. In accordance with this structure having the two curved portions 148*a*, 148*b*, a function such as that of a shortener can be added to surpass the function of a broach passed through a garment. More specifically, in a case where this arrangement is used as a shortener employed to correct an irregularity in two strings of pearls of a necklace of pearls or the like, it will suffice to insert the threads connecting the pearls in each of the spaces formed between the curved portions 148*a*, 148*b* and the broach main body. This manipulation can be carried out in simple fashion using one hand.

The sixth modification is capable of providing the effects of a broach similar to those of the fifth modification.

In the sixth modification, only one of the curved portions 148*a*, 148*b* can be provided so that the fastener can be employed as an open clip, by way of example. In this case, it will suffice to pass a broach whose pin end is opened between pearls of a pearl necklace, and attach the broach in such a manner that the thread connecting the pearls is inserted.

In the seventh modification shown in FIG. 15, the outer peripheral surface of a pin 155 is provided with a plurality of projections 155*a*. In the eighth modification shown in FIG. 16, the outer peripheral surface of a pin 165 is provided with a plurality of recesses 165*a*. In the ninth modification shown in FIGS. 17A and 17B, use is made of a pin 175 having a twisted structure in which the cross section has the shape of an octagon.

The shapes of the pins of the seventh, eighth and ninth modifications function to increase the frictional force relative to the sliding garment. Accordingly, in the seventh, eighth and ninth modifications, the broach can be prevented from simply falling off the garment.

Tenth through Twelfth Modifications

Tenth through twelfth modifications will now be described, in which the construction of the pressure-applying portion of the lever of the first embodiment is modified.

Figure 18:
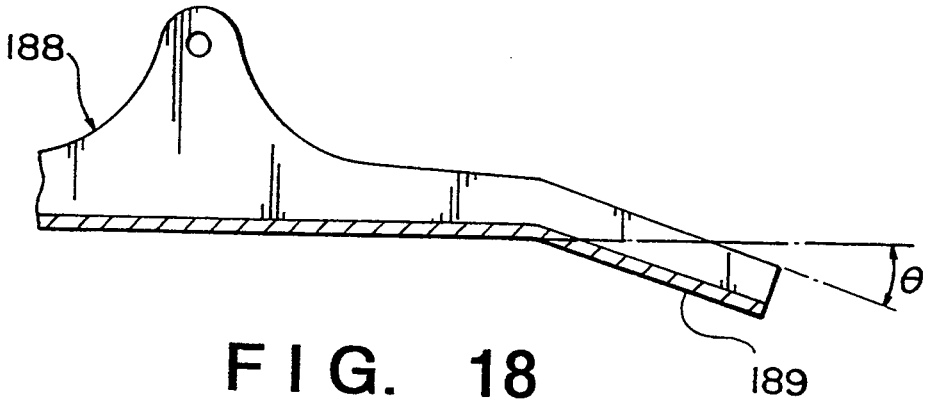
FIG. 18 is a side sectional view showing a principal portion of a tenth modification in which a lever of the first embodiment is modified.
Figure 19:
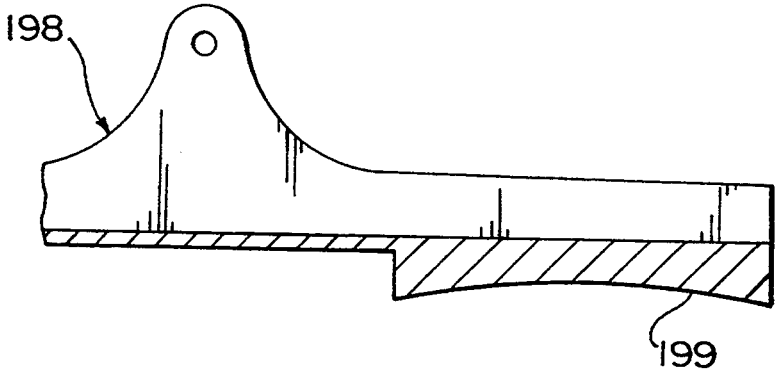
FIG. 19 is a side sectional view showing a principal portion of an 11th modification in which a lever of the first embodiment is modified.
Figure 20:
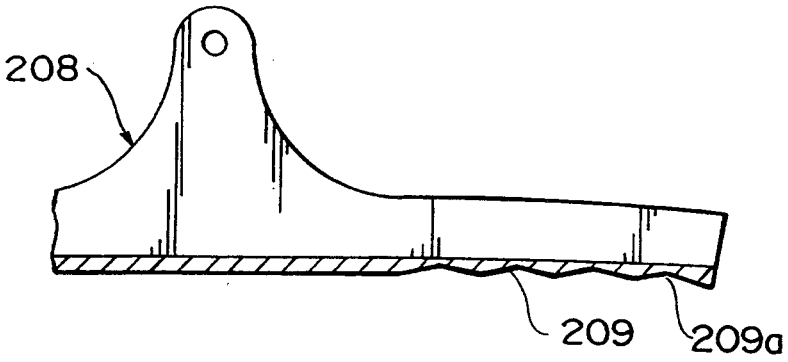
FIG. 20 is a side sectional view showing a principal portion of 12th modification in which a lever of the first embodiment is modified.

FIG. 18 is a side sectional view showing a principal portion of a tenth modification in which a lever of the first embodiment is modified; FIG. 19 is a side sectional view showing a principal portion of an 11th modification in which a lever of the first embodiment is modified; and FIG. 20 is a side sectional view showing a principal portion of 12th modification in which a lever of the first embodiment is modified.

First, in the tenth modification shown in FIG. 18, the rear end of a lever 188, namely a pressure-applying portion 189, has a shape bent downwardly at an angle $\theta$.

In the 11th modification shown in FIG. 19, the rear end of a lever 198 is provided with a pressure-applying portion 199 on a concave surface. In the 12th modification shown in FIG. 20, the rear end of a lever 208 is provided with a pressure-applying portion 209 in which a plurality of grooves are arrayed in a direction which crosses the longitudinal direction of the lever 208. It is permissible also to array these grooves in a direction longitudinal of the lever 208.

Thus, according to the tenth modification, 11th modification and 12th modification, the ease with which the finger contacts the lever and the engagement of the finger with the lever are improved, as a result of which excellent operability can be obtained when the broach is attached and detached. In addition, by improving the engagement of the finger, the pin can be opened and closed without inconvenience even when the broach (fastener) is small in size.

13th Modification

Figure 21:
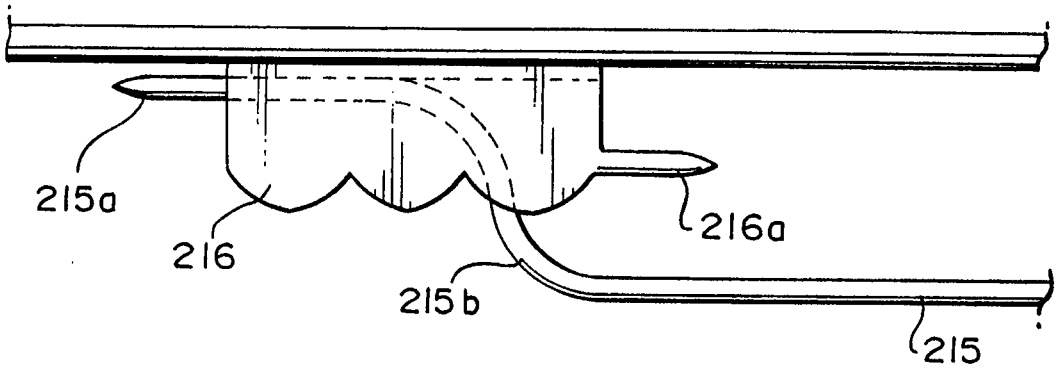
FIG. 21 is a side view showing the construction of a principal portion of 13th modification of the first embodiment.

FIG. 21 is a side view showing the construction of a principal portion of a 13th modification of the first embodiment.

The 13th modification is an example in which the construction of the pin accommodating portion of the first embodiment is modified. As shown in FIG. 21, a pin accommodating portion 216 which receives a tip 215*a* of a pin 215 has a sharp projection 216*a* protruding rearwardly from at least one side portion 216*b*, namely in the direction of the lever, not shown. In the 13th embodiment, if the garment shifts and moves up to the pin accommodating portion 216 after the broach is attached to the garment, the projection 216*a* will pierce the garment without harming the body of the wearer, thereby making it possible to check any further movement of the garment toward the side of the pin accommodating portion 216.

14th Modification

Figure 22B:
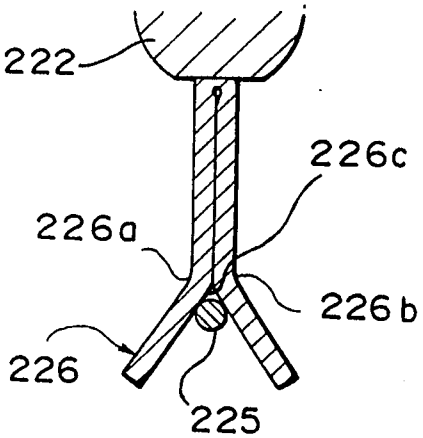
FIG. 22B is a front sectional view showing a cross section taken along line 22B—22B of the principal portion shown in FIG. 22A.
Figure 22A:
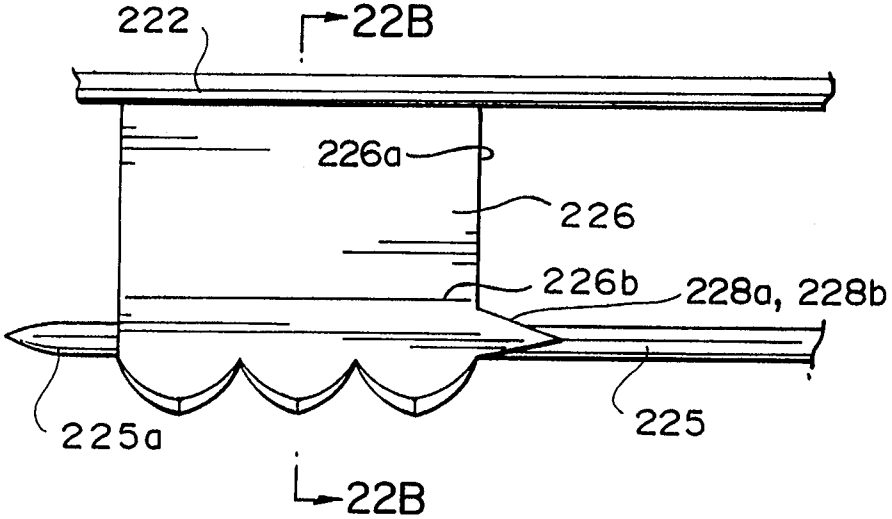
FIG. 22A is a side view showing the construction of a principal portion of 14th modification of the first embodiment.

FIG. 22A is a side view showing the construction of a principal portion of 14th modification of the first embodiment, and FIG. 22B is a front sectional view showing a cross section taken along line 22B—22B of the principal portion shown in FIG. 22A.

According to the first embodiment shown in FIG. 3, the curved portion 35*b* is provided in the proximity of the pin tip. However, the present invention is not limited to such an arrangement, for the pin can be formed to be substantially linear. In such case, as shown in FIG. 22B, a pin accommodating portion 226 attached to a main body 222 of a broach is provided to have a Y-shaped cross section, and the difference in level between the pin tip and the pin main body formed by the curved portion 35*b* is made up for by the height of side portions 226*a*, 226*b*. A pin 225 is accommodated with the portion at which the side portions 226*a*, 226*b* separate from each other being used as a bottom portion 26*c*. The side portions 226*a*, 226*b* of the pin accommodating portion 226 have respective projections 28*a*, 228*b* extending rearwardly at the position of the bottom portion 226*c*.

Thus, even if a difference in level between the pin tip and the pin main body is not formed in the axial direction of the pin 225, the projections 228*a*, 228*b* respectively provided on the side portions 226*a*, 226*b* in lieu of the difference in level directly receive the displacement of the garment. As a result, shifting of the garment while the broach is being worn is limited here also, and the broach can be prevented from simply slipping off the garment. Of course, the effect of suppressing displacement of the garment is obtained also by the projections protruding from the side portions 26*a*, 226*b* of the pin accommodating portion 226.

15th Modification

Figure 23:
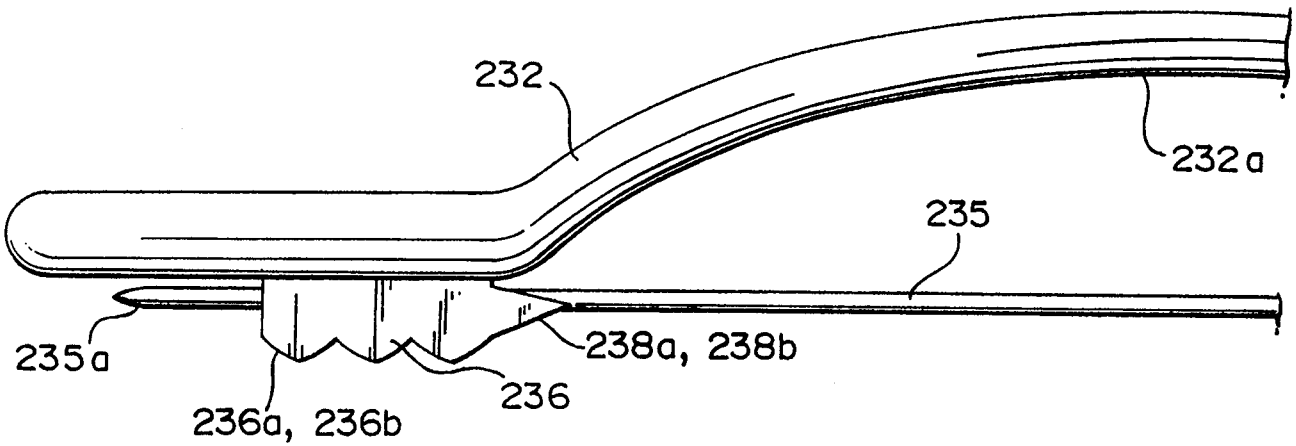
FIG. 23 is a side view showing the construction of a principal portion of 15th modification of the first embodiment.

FIG. 23 is a side view showing the construction of a principal portion of 15th modification of the first embodiment.

As shown in FIG. 23, the broach of the 15th modification has a construction in which, like the 14th modification, a pin 235 is provided to be substantially linear and has a pin accommodating portion 236 similar to the pin accommodating portion 36 of the first embodiment illustrated in FIG. 3. In the 15th modification also, a shown in FIG. 23, side portions 236*a*, 236*b* have respective projections 238*a*, 238*b* protruding rearwardly, as in the 14th modification described above. A main body 232 has a curved portion 232*a* curved so as to form an arc directed away from a pin 235. Owing to the curved portion 232*a*, space capable of absorbing the thickness of the fabric penetrated by the pin 236 is formed between the main body 232 and the pin 235.

In the 15th modification also, if the garment shifts, the projections 238*a*, 238*b* provided on the side portions 236*a*, 236*b* of the pin accommodating portion directly contact the fabric, as in the 14th modification. As a result, shifting of the garment while the broach is being worn is limited, and the broach can be prevented from simply slipping off the garment.

The modifications of the first embodiment described above can be used singly or in combination.

Second Embodiment

In the first embodiment and its modifications described above, the pin accommodating portion is strictly an immovable element for receiving the tip of the pin. However, this does not impose a limitation upon the present invention, for an arrangement can be adopted in which the cover follows up the operation wherein the pin is received within the pin accommodating portion, thereby covering the pin tip so that it will not be exposed to the outside.

As in the first embodiment, the second embodiment comprises a main body having one or more ornamental portions, and a fastener axially supported on a connection portion of the main body, though these elements are not shown.

Figure 24:
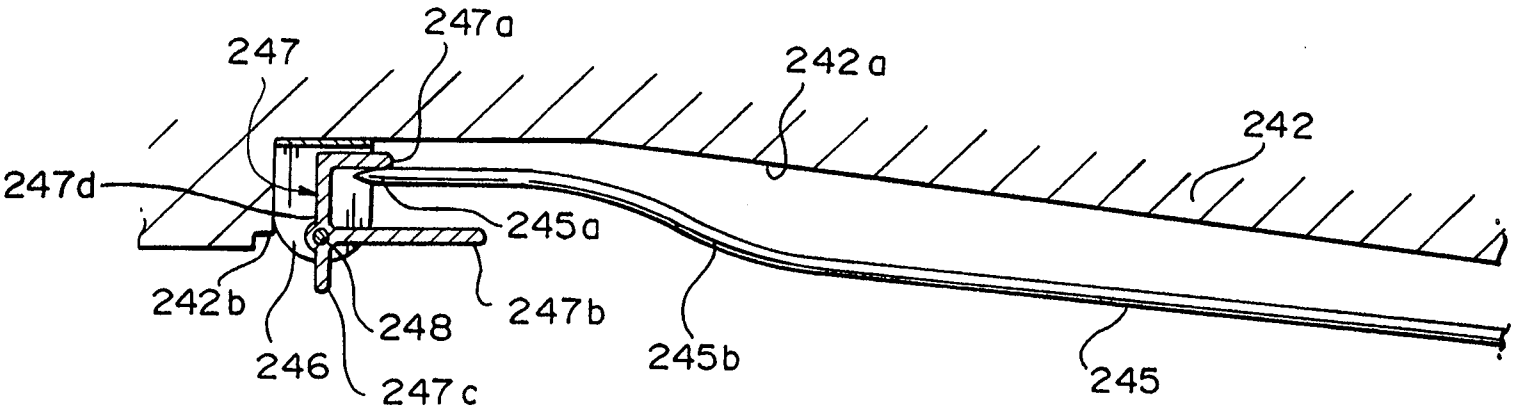
FIG. 24 is a side sectional view showing the construction of a principal portion of a second embodiment according to the present invention.

FIG. 24 is a side sectional view showing the construction of a principal portion of the second embodiment of the present invention. With regard to the principal portion of the broach according to the second embodiment illustrated in FIG. 24, a main body 242 is formed to have a recess 242*a* slanting forwardly (to the left in the drawing) from the position of the connection portion (not shown) up to a predetermined position, and a pin accommodating portion 246 according to the second embodiment is attached at the forward end (the left end in the drawing) of the recess 244*a* so as to be concealed from view. The recess 242*a* has a depth approximately equivalent to an axially directed difference in level between the main body of a pin 245 and a pin tip 245*a*.

The pin accommodating portion 246 has a construction possessing two opposing tongue-shaped side portions, and a follower 247, which has an F-shaped cross section, freely rotatably supported by a shaft 248 spanning the distal ends of the two side portions. With regard to the follower 247 shown in FIG. 24, an upper plate urged upwardly by the pin 245 defines a pin receiving plate 247*a* which receives the tip 245*a* of the pin 245 when the broach is in an initial state prior to being attached and when the broach is in the attached state. Further, a plate provided substantially in parallel with the pin receiving plate 247*a* defines a covering plate 247*b* which covers the tip 245*a* of the pin 245 received by the pin receiving plate 247*a* when the broach is in an initial state prior to being attached and when the broach is in the attached state. A connecting plate 247*d* which connects the parallel pin receiving plate 247*a* and covering plate 247*b* is penetrated by a shaft 248 at a position where the shaft intersects the covering plate 247*b*. The follower 247 has a stopper 247*c* projecting from the position penetrated by the shaft 248 and directed along an extension line from the connecting plate 247*d*. The material constituting the follower 247 can be the same as that of the main body and fastener described above.

The operation of the principal portion of the second embodiment will now be described in accordance with the manipulation procedure.

FIGS. 25A through 25E are side views for describing a procedure for attaching the broach according to the second embodiment.

Figure 25A:
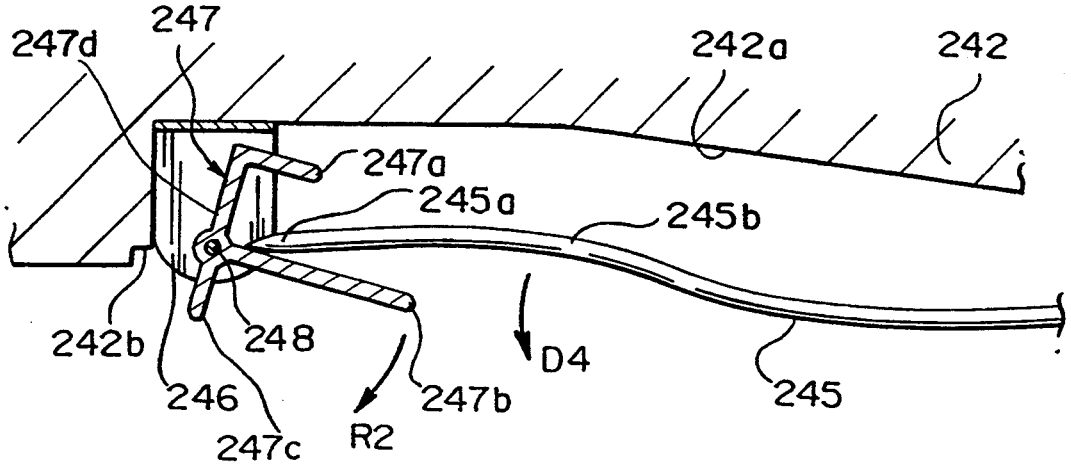
FIGS. 25A–25E are side views for describing a broach attaching procedure according to the second embodiment.
Figure 25B:
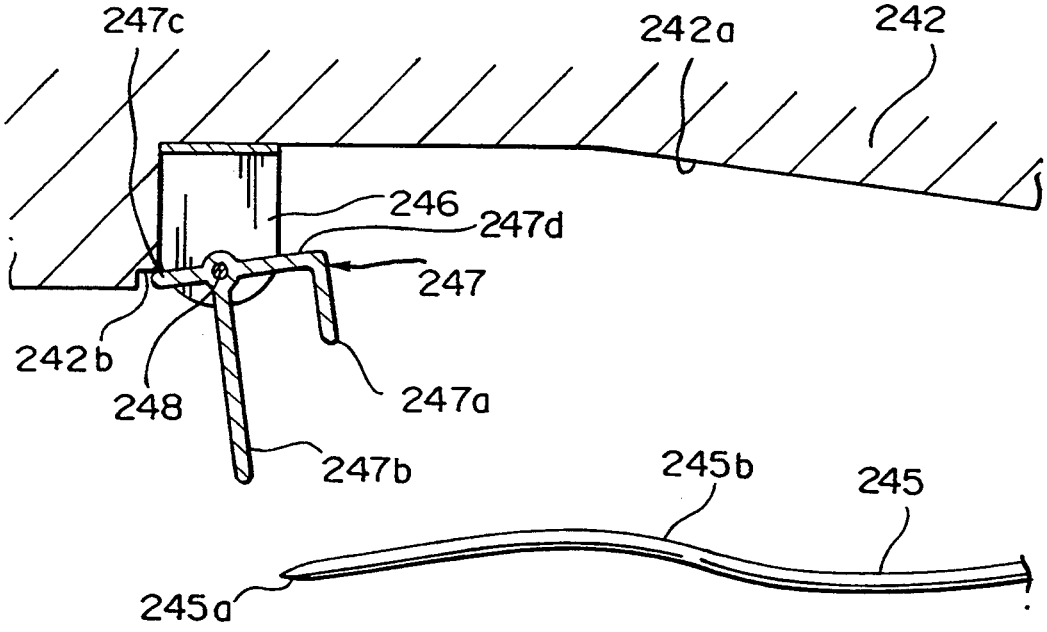
Figure 25C:
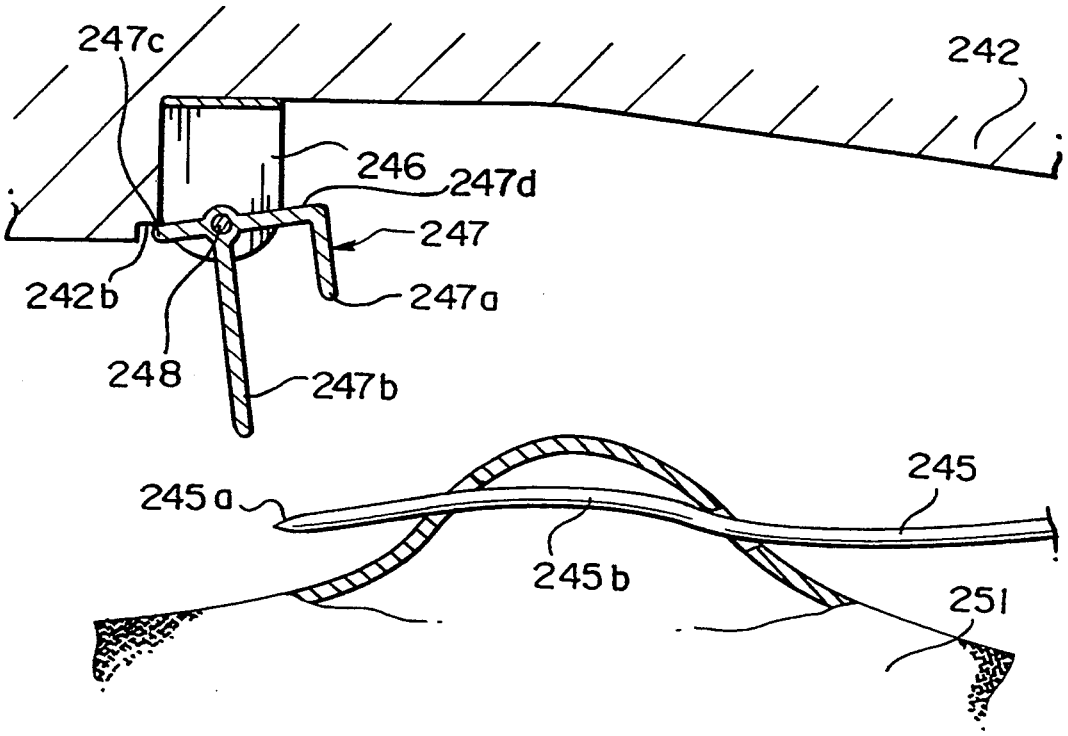

First, starting from the initial state shown in FIG. 24, the user manipulates the lever (not shown) to rotate the pin 245 in the direction indicated by arrow D4, as shown in FIG. 25A. As a result of this operation, the tip 245*a* of pin 245 separates from the pin receiving plate 247*a* of the follower 247, abuts against the side face of the covering plate 247*b* and causes the follower 247 to rotate about shaft 248 in the direction indicated by arrow R2, i.e., to follow up the motion of the pin. When the operation for moving the tip 245*a* of pin 245 to a position at which it is completely freed from the accommodated state has been performed (FIG. 25B), the user passes the tip 245*a* through a garment 251 (FIG. 25C) just as in the first embodiment. When the pin 245 has separated from the follower 247, the latter is capable of turning freely. However, if the follower 247 is rotated in the direction of arrow R2, the stopper 247*c* is received by a stopper receiving portion 242*b* provided on the wall portion of the main body 242 adjacent the pin accommodating portion 246. As a result, rotation of the follower 247 in the R2 direction is limited. With regard to the positional relationship between this limit position and the position at which the pin is freed, an angle is set that allows some rotation of the follower 247.

Figure 25D:
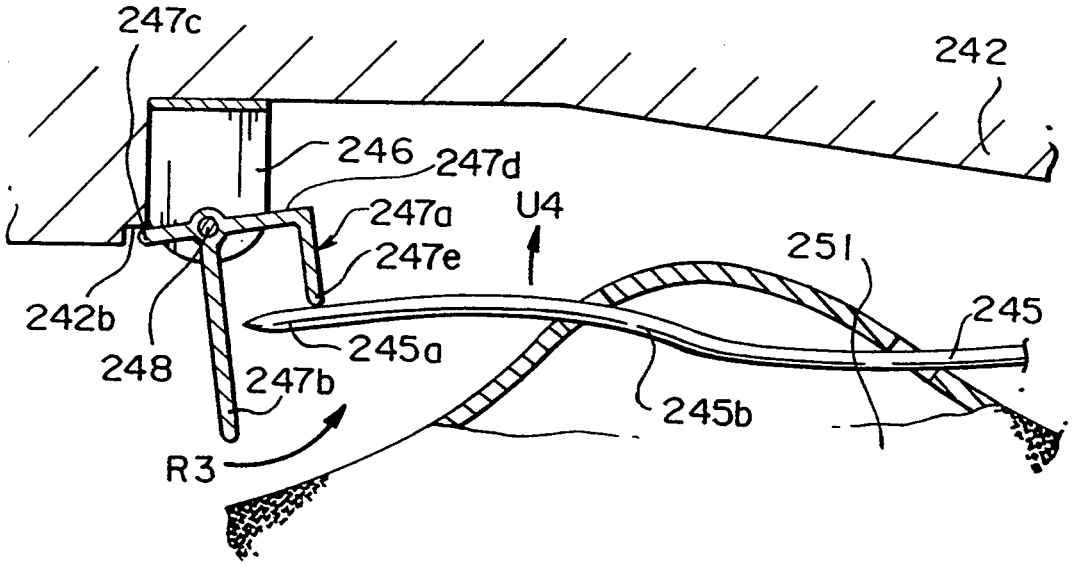
Figure 25E:
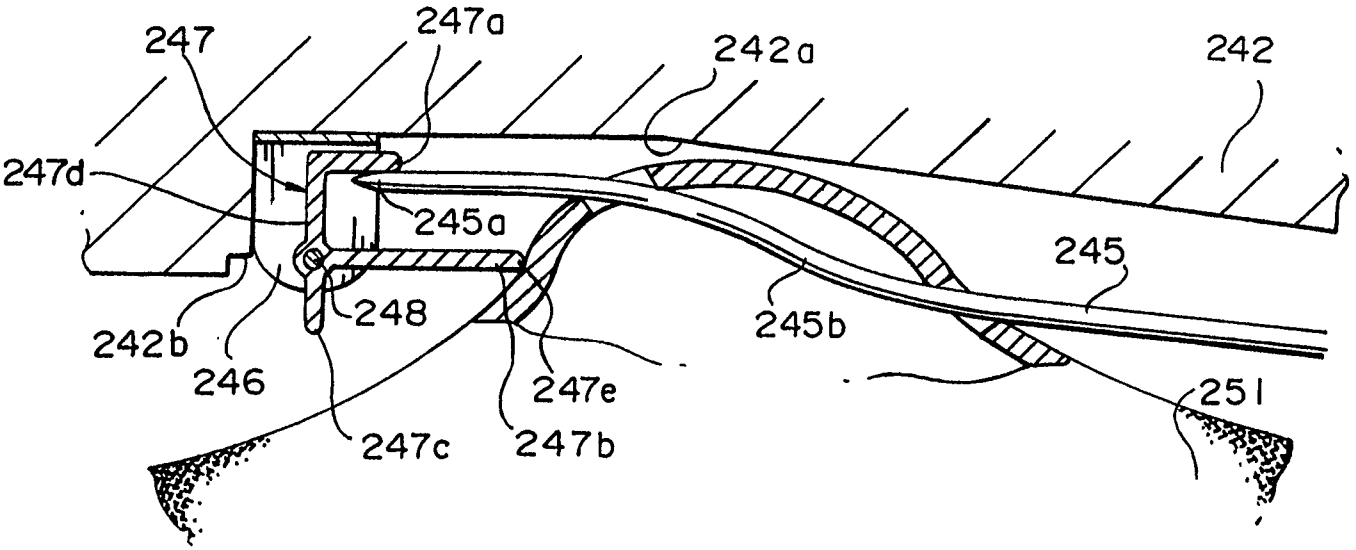

Next, the user sets the freely rotatable follower 247 at the above-mentioned limit position and removes the force applied to the lever (not shown). As a result of this operation, the pin 245, which has been passed through the garment 251, rotates in the direction indicated by arrow U4 in accordance with the operation that restores the fastener to its original state. Owing to such rotation, the tip 245*a* first abuts against and forces upward the distal end 247*d* of the pin receiving plate 247*a* so that the pin receiving plate 247*a*, namely the follower 247, is rotated in the direction indicated by arrow R3 (FIG. 25D). Furthermore, the pin 245 rotates to attain its initial state shown in FIG. 24, so that the broach of the second embodiment is attached to the garment 251, as depicted in FIG. 25E.

In accordance with the second embodiment described above, substantially the entirety of the pin is accommodated within the main body. As a result, the broach can be affixed to the garment more closely in comparison with the affixed state of the first embodiment, and therefore tilting of the entire broach about the fastener portion as an axis can be eliminated. In addition, accommodating substantially the entire pin within the main body makes it possible to enhance safety. Of course, the effects obtained with the first embodiment can be obtained with the second embodiment as well.

The modifications of the first embodiment described above can be applied to the second embodiment singly or in plural.

Though the present invention has been described in the foregoing embodiments by taking a broach as a typical example of an ornamental device, the invention can also be adapted to an open clip attached to a pearl necklace, a shortener attached to two strings of pearls of a pearl necklace, a tie pin or a pin used in setting hair. In case of an ornamental device set directly on the human body, such as in the hair, the tip should not be sharpened more than necessary.

The present invention is not limited to the above-described embodiments but can be modified in various ways within the scope of the claims.

What is claimed is:

1. A fastener attached to a main body of an ornamental device, characterized by comprising:

connecting means for freely rotatably connecting the fastener to said main body;

a pin extending in one direction and a lever of said pin extending in another direction, from a portion connected at said connecting mean;

biasing means for biasing a distal end of said pin toward said main body about a rotary shaft constituted by said connecting means; and accommodating means for accommodating said distal end of said pin at a portion where said biasing means causes said distal end to abut against an outer surface of said main body;

said pin having a plurality of juxtaposed pins in the longitudinal direction thereof, and said accommodating means has projections between the pins which limit accommodating positions when said plurality of pins are accommodated;

said pin including difference-in-level means for shifting the axial direction of the pin in the proximity of its distal end toward said main body.

2. A fastener according to claim 1, characterized in that said pin has a cross sectional shape that is polygonal.

3. A fastener according to claim 1, characterized in that opposing ones of said plurality of pins have symmetrically widened curved portions and symmetrically narrowed curved portions.

4. An ornamental device which uses a fastener, said fastener characterized by comprising:

connecting means for freely rotatably connecting the fastener to said main body;

a pin extending in one direction, and a lever of said pin extending in another direction, from a portion connected at said connecting means;

biasing means for biasing a distal end for said pin toward said main body about a rotary shaft constituted by said connecting means;

said pin including difference-in-level means for shifting the axial direction of the pin in the proximity of its distal end toward said main body;

accommodating means for accommodating said distal end of said pin at a portion where said biasing means causes said distal end to abut against an outer surface of said main body;

said accommodating means has a follower which rotates to follow up motion of the distal end of said pin when said distal end is received by and extracted from the accommodating means;

said follower being axially supported on said accommodating means and adapted to cover the distal end of said pin after the distal end is accommodated; and said main body has a recess for substantially receiving said pin when said pin is accommodated by said accommodating means, and said accommodating means is attached within said recess.

5. A fastener attached to a main body of an ornamental device, characterized by comprising:

connecting means for freely rotatably connecting the fastener to said main body;

a pin extending in one direction and a lever of said pin extending in another direction, from a portion connected at said connecting means;

biasing means for biasing a distal end of said pin toward said main body about a rotary shaft constituted by said connecting means; and accommodating means for accommodating said distal end of said pin at a portion where said biasing means causes said distal end to abut against an outer surface of said main body;

said accommodating means has a projection which protrudes in a direction opposite the direction of the accommodated distal end of said pin;

said pin including difference-in-level means for shifting the axial direction of the pin in the proximity of its distal end toward said main body.

* * * * *

UNITED STATES PATENT AND TRADEMARK OFFICE

CERTIFICATE OF CORRECTION

PATENT NO. : 5,355,563

DATED : October 18, 1994

INVENTOR(S) : Kiyohiro Kanno

It is certified that error appears in the above-identified patent and that said Letters Patent is hereby corrected as shown below:

Cover page, "[22] PCT Filed: March 1, 1991", should read --[22] PCT Filed: March 1, 1990--.

Signed and Sealed this

Thirtieth Day of May, 1995

*Attest:*

*Attesting Officer*

BRUCE LEHMAN

*Commissioner of Patents and Trademarks*